US006309377B1

(12) United States Patent
Tsujiyama et al.

(10) Patent No.: US 6,309,377 B1
(45) Date of Patent: Oct. 30, 2001

(54) NON-WOVEN FABRIC AND AN ABSORBENT ARTICLE USING THEREOF

(75) Inventors: Yoshimi Tsujiyama; Taiju Terakawa; Toshikatsu Fujiwara, all of Shiga (JP)

(73) Assignee: Chisso Corporation, Osaka (JP)

( * ) Notice: Subject to any disclaimer, the term of this patent is extended or adjusted under 35 U.S.C. 154(b) by 0 days.

(21) Appl. No.: 09/245,671

(22) Filed: Feb. 8, 1999

Related U.S. Application Data

(63) Continuation of application No. PCT/JP97/02931, filed on Aug. 27, 1996.

(30) Foreign Application Priority Data

Aug. 27, 1996 (JP) ..... 8-225077

(51) Int. Cl.[7] ..... A61F 13/15

(52) U.S. Cl. ..... 604/367; 604/385.01; 428/113; 428/296.7; 428/299.7; 428/364

(58) Field of Search ..... 604/385.1, 367; 428/113, 296.7, 299.7, 364

(56) References Cited

U.S. PATENT DOCUMENTS

| | | | | |
|---|---|---|---|---|
| 5,057,368 | * | 10/1991 | Largman et al. | 428/397 |
| 5,069,970 | * | 12/1991 | Largman et al. | 428/373 |
| 5,314,743 | * | 5/1994 | Meirowitz et al. | 428/297 |
| 5,342,336 | * | 8/1994 | Meirowitz et al. | 604/378 |
| 5,458,963 | * | 10/1995 | Meirowitz et al. | 428/297 |
| 5,634,914 | * | 6/1997 | Wilkes et al. | 604/375 |
| 5,972,505 | * | 10/1999 | Phillips et al. | 428/397 |

FOREIGN PATENT DOCUMENTS

| | | |
|---|---|---|
| 56-20615 | 2/1981 | (JP) . |
| 1-201513 | 8/1989 | (JP) . |
| 1-250412 A | 10/1989 | (JP) . |
| 2-169723 | 6/1990 | (JP) . |
| 2-214729 | 8/1990 | (JP) . |
| 4-209825 | 7/1992 | (JP) . |
| 5-140849 | 6/1993 | (JP) . |
| 5-186954 | 7/1993 | (JP) . |
| 6-73613 A | 3/1994 | (JP) . |
| 8-158227 | 6/1996 | (JP) . |
| 9-299403 A | 11/1997 | (JP) . |
| WO 97/21862 | 6/1997 | (WO) . |

OTHER PUBLICATIONS

No Translation Provided.

* cited by examiner

*Primary Examiner*—John G. Weiss
*Assistant Examiner*—Paul Shanoski
(74) *Attorney, Agent, or Firm*—Merchant & Gould P.C.

(57) ABSTRACT

A non-woven fabric composed of thermoplastic fiber comprising at least two resin components A and B and having a cross section where the component A forms a branching fiber in which a plurality of strands extend radially from the center to the outside and the component B forms a fine fiber which connects to and protrudes from the branching fiber; split branch fibers of the conjugated fiber; and split fibers of the fine fibers, and an absorbent article using the non-woven fabric. The non-woven fabric of the present invention has an excellent hand feeling and sufficient bulkiness, and it is suitable for absorbent articles such as disposable diapers, sanitary napkins, and pads for incontinence or the like.

12 Claims, 6 Drawing Sheets

NON-WOVEN FABRIC AND AN ABSORBENT ARTICLE USING THEREOF

This application is a continuation of Ser. No. PCT/JP97/02931 filed Aug. 27, 1996.

TECHNICAL FIELD

The present invention relates to a non-woven fabric comprising fibers containing thermoplastic modified cross section fibers (non-circular cross section fibers) and an absorbent article using the non-woven fabric. More particularly, it relates to a non-woven fabric comprising fibers that contain thermoplastic modified cross section fibers and having a high bulkiness and an excellent hand feeling, and to an absorbent article using the above mentioned non-woven fabric.

BACKGROUND ART

Hitherto, non-woven fabrics are used for various applications, such as clothes, industrial materials, materials for civil engineering and construction, materials for agriculture and gardening, materials for daily necessities, medical and hygienic materials etc. In particular, as compared with a non-woven fabric composed of staple fibers, a non-woven fabric composed of filaments has higher strength and is higher in productivity. Therefore, a non-woven fabric composed of filaments is more widely used. A non-woven fabric composed of filaments, which is rich in softness and has an excellent hand feeling, has been sought. For example, Japanese Patent Application Laid Open No. Hei 5-186954 discloses a non-woven fabric produced by a process wherein a sunflower section- type cross section filament is split into two types of fibers: a fiber having a fine fineness and a fiber having a fineness that is three times as fine as that of the former fiber. This type of non-woven fabric has a softness, but it does not have a high bulkiness. Moreover, Japanese Patent Application Laid Open No. Hei 5-140849 discloses a tangled non-woven fabric produced by a process wherein a splittable bicomponent type continuous fiber is split by providing a high pressure membrane liquid flow, and further providing a high pressure membrane liquid flow in order to tangle these split fibers each other. This type of non-woven fabric has a softness, but it lacks in bulkiness. Moreover, in the above mentioned fabrics, the manufacturing step becomes complicated and the manufacturing cost increases.

Moreover, a non-woven fabric is widely used for absorbent articles such as disposable diapers, sanitary napkins, incontinence pads or the like. In general, a non-woven fabric is used as a surface material (a material for the side contacting with the users' skin) of the absorbent article. Therefore, in a case where a less bulky non-woven fabric is used in an absorbent article, there were some disadvantages: that is, a permeability of body fluid such as urine, sweat, blood or the like is not excellent; the bleeding of body fluid from the article is great, the feeling of dryness is deteriorated due to a back flow of body fluid once absorbed by the absorbent article; and the softness is not obtained and a comfortable feeling for users is accordingly deteriorated.

As mentioned above, a non-woven fabric which has a sufficient softness and an excellent hand feeling has been sought, but the non-woven fabric which satisfies the above mentioned both conditions has never been produced.

The object of the present invention is to provide a non-woven fabric having an excellent hand feeling and a sufficient bulkiness. Another object of the present invention is to provide an absorbent article using the above mentioned non-woven fabric, which has an excellent hand feeling and touch, a high permeation speed with respect to fluid to be absorbed, a low exudation property, and a small back flow of the permeated fluid by the absorbent article.

SUMMARY OF INVENTION

Accordingly, the invention is found in a non-woven fabric which includes thermoplastic fibers. These fibers include a splittable conjugated fiber that has at least two resin components A and B and has a cross section where the component A includes a branch fiber in which a strand of the branch fiber extends radially from the center of the conjugated fiber to the outside of the conjugated fiber and the component B includes a fine fiber which connects to and protrudes from the branch fiber. The fibers also include split branch fibers that has been split from the conjugated fiber and split fine fibers that has been split from the conjugated fiber.

BRIEF DESCRIPTION OF DRAWINGS

FIGS. 5(*b*) and (*c*) are cross sectional views showing examples of split fibers that can be obtained by splitting the splittable conjugated fiber in FIG. 5(*a*).

FIGS. 6(*b*) to (*g*) are cross sections views showing examples of split fibers that can be obtained by splitting the splittable conjugated fiber in FIG. 6(*a*).

DETAILED DESCRIPTION

Figure 1:
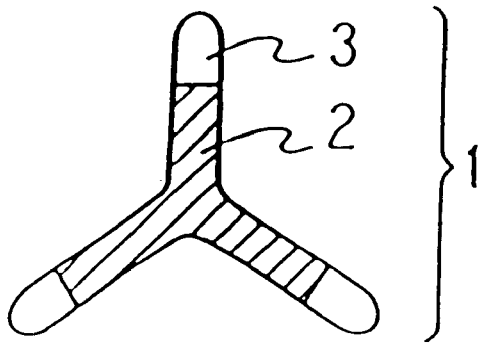
FIG. 1 is a cross sectional view showing one embodiment of a splittable conjugated fiber used in the present invention.

The present invention provides a non-woven fabric and an absorbent article as follows:

(1) A non-woven fabric which comprises thermoplastic fibers comprising: splittable conjugated fibers comprising at least two resin components A and B and having a cross section where the component A forms a branch fiber in which a strand extends radially from the center to the outside and the component B forms a fine fiber which connects to and protrudes from the branch fiber; split branch fibers of the conjugated fiber; and split fibers of the fine fibers.

(2) The non-woven fabric according to the above item (1), wherein the splittable conjugated fiber has a different component from the component A in the center of the component A, and the split fiber comprising the different component is further mixed in the fibers of the non-woven fabric.

(3) The non-woven fabric according to the above item (1), wherein the splittable conjugated fiber comprises the component A and the component B, the component A forms the branch fiber in which at least three strands extend radially from the center to the outside, and the component B forms two or more fine fibers which protrude from the vicinity of the tip of each strand in a direction crossing the longitudinal direction of the strand and which extend in the opposite direction with respect to a fine fiber found at a facing position across each strand.

(4) The non-woven fabric according to the above item (3), wherein the splittable conjugated fiber has the different component from the component A in the center of the component A, and the split fiber comprising the different component is further mixed in the fibers of the non-woven fabric.

(5) The non-woven fabric according to the above item (1), wherein the resin component constituting the thermoplastic fiber is at least one selected from the group consisting of polyolefin resin, polyester resin, and polyamide resin.

(6) The non-woven fabric according to the above item (1), wherein the thermoplastic fiber comprises a filament which is a continuous fiber.

(7) An absorbent article using the non-woven fabric described in any one of the above items (1) to (6).

Since each resin component of components A and B or more components constituting the conjugated fiber used in the present invention is required to be split by adding an external force to the conjugated fiber, the combination of such components that are incompatible with each other is preferable (Hereinafter, to simplify the explanation, the above mentioned combination of two components or more will be represented by only two components A and B, unless otherwise noted). By using a combination wherein the components A and B are incompatible with each other, the conjugated fiber in which both components are easily split when an impact is given can be provided.

Moreover, it is preferable that the difference in the melting points between the components A and B is not less than 15° C. If the difference in the melting points between the components A and B is less than 15° C., when a web is thermally adhered by using a thermal roll at temperatures near and below the melting point of the low melting point component, fibers comprising the high melting point component in the non-woven fabric shrink due to the heat, so that the hand feeling tends to be bad. In addition, in a method of adhering fibers by circulating hot air, if the treatment temperature is higher than the melting point of the low melting point component, even the high melting point component also might be melted, thus deteriorating a hand feeling. Moreover, it is preferable that in a case where a conjugated fiber is composed of three components or more, the difference between the melting point of the component having the highest melting point and the melting point of the component having the lowest melting point is not less than 15° C.

Moreover, in a case where each resin component does not have a melting point, a softening point is substituted for the melting point. In the present invention, the melting point is measured by using a thermal analyst "2000", the product of DuPont Instruments, while increasing a temperature at 1° C./min, and the temperature showing a maximum value of the melting endothermic peak is regarded as the melting point.

Preferable examples of resin components of a thermoplastic fiber which can be used in the present invention include polyolefin resin, polyester resin, polyamide resin or the like. Polyolefin resin is, for example, polypropylene, high density polyethylene, linear low density polyethylene, ethylene/propylene binary copolymer, ethylene/butene-1/propylene terpolymer or the like. Polyester resin is, for example, polyethylene terephthalate, polybutylene terephthalate or the like. Polyamide resin is, for example, nylon 6, nylon 66 or the like. In addition, as long as the effect of the present invention is not harmed, pigments, flame retardant, deodorants, anti-static agents, antioxidants etc. may be added to the conjugated fiber composed of the above mentioned resin components.

The conjugated fiber used in the present invention is required to comprise a thermoplastic fiber comprising at least two resin components A and B, and having a modified cross section wherein the components A forms a branch fiber in which a plurality of strands extend from the center to the outside and the component B forms a fine fiber which connects to and protrudes from the branch fiber.

Figure 4:
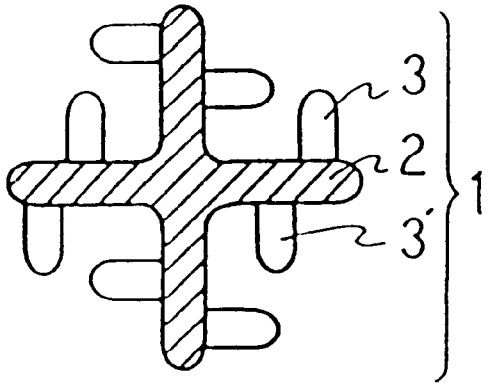
FIG. 4 is a cross sectional view showing a further embodiment of a splittable conjugated fiber used in the present invention.
Figure 5:
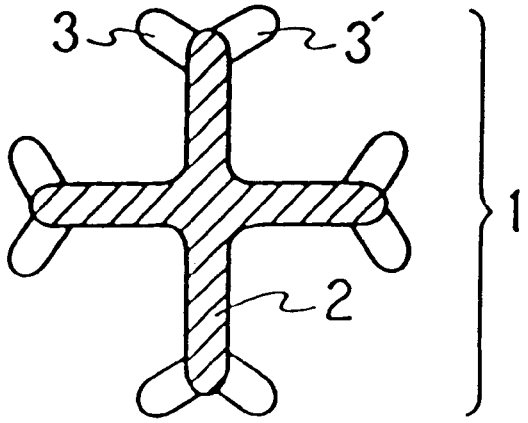
FIG. 5(*a*) is a cross sectional view showing a further embodiment of a splittable conjugated fiber used in the present invention.
Figure 5:
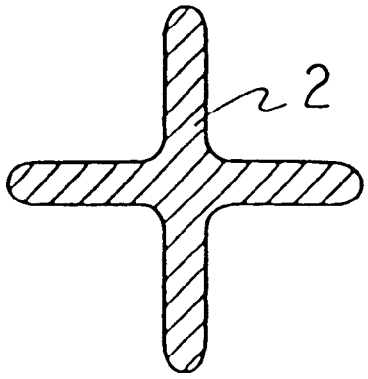
Figure 5:
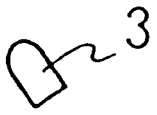
Figure 6:
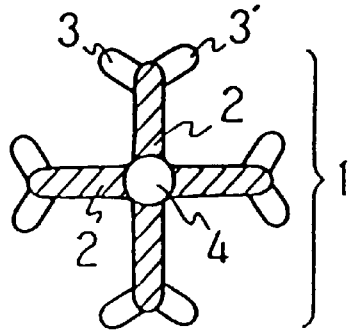
FIG. 6 is a cross sectional view of a further embodiment of a splittable conjugated fiber used in the present invention.
Figure 6:
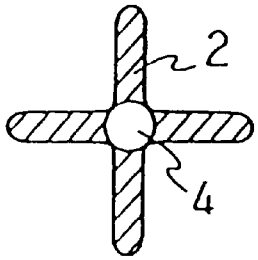
Figure 6:
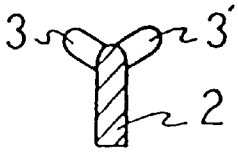
Figure 6:
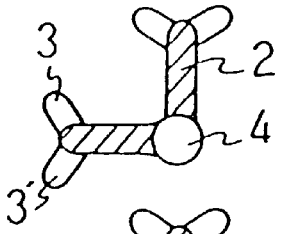
Figure 6:
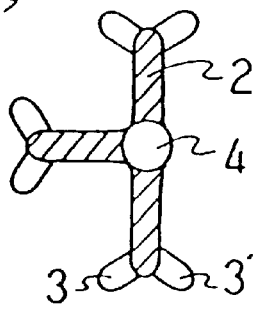
Figure 6:
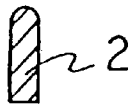
Figure 6:
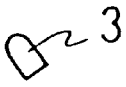

Examples of the cross section of the conjugated fiber satisfying the above mentioned requirements are shown in FIG. 1 to FIG. 6. In the figures, numeral 1 denotes a conjugated fiber, 2 denotes a branch fiber comprising the component A, in which a plurality of strands extend radially from the center to the outside; 3, 3' denote fine fibers comprising the component B, which are connected to and protrude from the branch fiber. In FIG. 6(*a*) to (*e*), numeral 4 denotes a fiber comprising a different component from the component A, which is located in the center of the component A.

FIG. 1 shows the cross section of the splittable conjugated fiber 1 comprising the component A and component B, wherein the component A forms the branch fiber 2 in which three strands extend radially from the center to the outside, and the component B forms the fine fiber 3 which connects to and protrudes from the tip of each strand in the direction parallel to the longitudinal direction of each strand.

Figure 2:
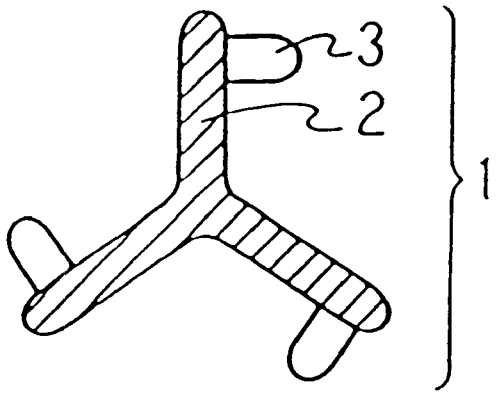
FIG. 2 is a cross sectional view showing another embodiment of a splittable conjugated fiber used in the present invention.

FIG. 2 shows the cross section of the splittable conjugated fiber 1 comprising the component A and component B, wherein the component A forms the branch fiber 2 in which three strands extend radially from the center to the outside, and the component B forms the fine fiber 3 which protrudes from the vicinity of the tip of each strand in a direction that intersects the longitudinal direction of each strand of the branch fiber 2 (in this figure, the fine fiber extends in the direction crossing at approximately a right angle to each strand, however, the crossing angle may optionally be determined). The crossing angle in not particularly limited, but it is preferable that the crossing angle is in the range of 20 to 120°.

Figure 3:
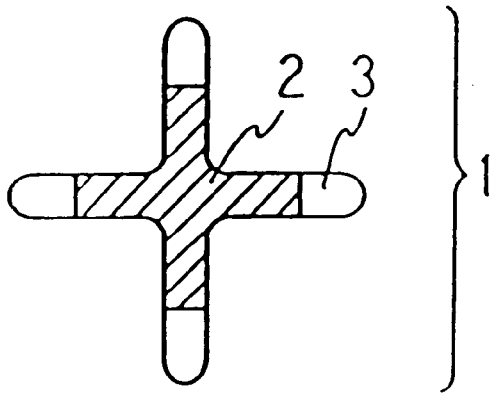
FIG. 3 is a cross sectional view showing a further embodiment of a splittable conjugated fiber used in the present invention.

FIG. 3 shows the cross section of the splittable conjugated fiber 1 comprising the component A and component B, wherein the component A forms the branch fiber 2 in which four strands extend radially from the center to the outside, and the component B forms the fine fiber 3, which connects to and protrudes from the tip of each strand in the parallel direction to the longitudinal direction of each strand.

FIG. 4 shows the splittable conjugated fiber 1 comprising the component A and component B, wherein the component A forms the branch fiber 2 in which four strands extend radially from the center to the outside, and the component B forms the fine fibers 3 and 3', which protrude from the vicinity of the tip of each strand in a direction that intersects the longitudinal direction of the strand and which extend in the direction opposite to that of the fine fiber 3 or 3' at the other face of the strand of each branch fiber 2. (In this figure, the fine fiber extends approximately in the direction crossing at a right angle to each strand, however, the crossing angle may optionally be determined. The same is true hereinafter.) In this case, the fine fibers 3 and 3' connect to the branch fiber in a way in which the fine fiber 3 connects at the vicinity of the tip of the strand; and the fine fiber 3' connects to the portion a little nearer to the center. The opposite fine fibers 3 and 3' may protrude from approximately the same position across the strand for each other.

FIG. 5(*a*) shows the splittable conjugated fiber 1 comprising the component A and component B, wherein the component A forms the branch fiber 2 in which four strands extend radially from the center to the outside, and the component B forms two fine fibers 3 and 3' which protrude from the vicinity of the tip of each strand in a direction that intersects the longitudinal direction of the strand and which extrude from approximately the same position in approximately opposite directions with respect to each other. (In this figure, the fine fiber extends in the direction at an angle slightly oblique from a right angle.)

FIG. 6(*a*) shows the splittable conjugated fiber 1, wherein a component different from the component A 4 is placed in the center of the branch fiber comprising the component A of the conjugated fiber 1 shown in FIG. 5(*a*). The different component 4 is not limited, as long as it is different from the component A. Therefore, it may be the same as the component B, and it may be the third component different from the components A and B.

According to the non-woven fabric of the present invention, the part of the above mentioned splittable conjugated fiber is split when producing the non-woven fabric. Therefore, in the split fiber components, the bulkiness can be provided by the branch fiber having a radial cross section in which strands radially extend, and an excellent hand feeling can be obtained by the fine fiber II which has a finer fineness than the branch fiber. Moreover, the non-woven fabric of the present invention is composed of fibers in which the not-split conjugated fiber 1, the branch fiber 2 and the fine fiber 3 are mixed. Since the presence of the not-split conjugated fiber 1 makes the bulkiness more excellent, the not-split conjugated fiber 1 is also required to partly exist in the non-woven fabric.

For example, in the case of the conjugated fiber 1 shown in FIG. 5(*a*), an excellent hand feeling is provided by the split fine fiber 3 shown in FIG. 5(*c*); and the high bulkiness is provided by the branch fiber 2 shown in FIG. 5(*b*) in which the fine fibers are split and removed from the conjugated fiber 1. In addition, in the case of the conjugated fiber shown in FIG. 5(*a*) in which the not-split conjugated fibers 1 are mixed, the protruding portions 3 and 3' prevent branches of the different branch fibers from entering the space between branches of the branch fiber 2, so that porosity of the non-woven fabric is enhanced more, and therefore the non-woven fabric rich in bulkiness is provided. Moreover, FIGS. 5(*b*) and (*c*) show the states in which the branch fiber comprising the component A, and the fine fiber comprising the component B are perfectly split. However, the branch fiber comprising the component A and a fine fiber comprising the component B are not necessarily split perfectly. It is also possible that the fine fibers 3 and/or 3' comprising the component B are not separated from some of four strands of the branch fiber 2 of the component A and mixed therein.

In addition, in the present invention, as shown in FIG. 6, the different component 4 from the component A may be placed at the center of the component A. The component placed in the center is not limited as long as it is not compatible with the component A. It may be the same as the component B and may be different from the component B. When the different component is included in the center of the component A, the branch fiber itself is also split at its central portion. Consequently, the non-woven fabric is provided, in which a plurality of modified cross section fibers shown in, for example, FIG. 6(*a*) to FIG. 6(*g*), are mixed after splitting treatment. FIG. 6(*b*) to FIG. 6(*g*) show only some examples of the cross sections of the split fibers. The mixing combination of each portion 2, 3, 3', and 4 is not limited to the above mentioned split forms and other combinations may be possible. Moreover, in this embodiment, the higher the fineness is, the higher the rigidity is. Therefore the fine fibers supplement the softness. Consequently, it is preferable that the appropriate balance of the split quantity of the branch fiber 2 and a fine fiber 3 is determined depending upon the types of the conjugated fiber. In the cases of FIG. 6(*a*) to FIG. 6(*g*), there are mixture of the following fineness: finest type, fine type, medium fine type, and thick type (FIGS. 6(*g*) and (*f*) correspond to the finest type, FIG. 6 (*c*) corresponds to the fine type, FIG. 6(*b*), (*d*) and (*e*) correspond to the medium fine type, and FIG. 6(*a*) corresponds to the thick type), so that the balance between the rigidity and the hand feeling becomes good. Moreover, the high bulkiness is also maintained.

Figure 8:
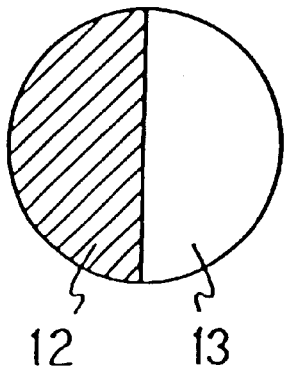
FIG. 8 is a cross sectional view showing one embodiment of the conventional splittable conjugated fiber.
Figure 9:
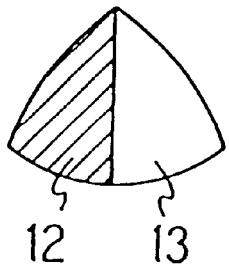
FIG. 9 is a cross sectional view showing another embodiment of the conventional splittable conjugated fiber.
Figure 10:
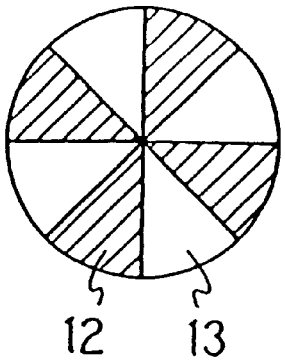
FIG. 10 is a cross sectional view showing a further embodiment of the conventional splittable conjugated fiber.

FIGS. 8 to 10 show the cross sectional views of the conventional conjugated fibers. In these figures, numeral 12 denotes a high melting point component (the component A), and 13 denotes a low melting point component (the component B). In a case where the cross sectional shape of the conjugated fiber does not satisfy the essential conditions of the present invention like the above, it is difficult for the conjugated fiber to be split into the components A and B. Moreover, if such conjugated fiber is split, in the cross section like A and B after the splitting treatment, the satisfactory bulkiness cannot be obtained.

In the non-woven fabric of the present invention, it is preferable that the splitting ratio of the above mentioned conjugated fiber is in the range of 30 to 95%. The splitting ratio is calculated with an equation discussed below in conjunction with FIG. 7. More preferably, it is in the range of 30 to 90%. It is preferable that the splitting ratio is in the above mentioned range, since a high bulkiness and an excellent hand feeling can be retained.

A non-woven fabric produced by mixed fibers comprising at least one conjugated fiber from the conjugate fibers shown in FIG. 1 to FIG. 5(*a*) and the conjugated fiber FIG. 6(*a*) is a particularly preferable embodiment, since the soft hand feeling and high bulkiness can be provided by appropriately controlling the mixing ratio.

The fineness of the splittable conjugated fiber used in the present invention is not limited and may be selected depending upon the objects. In general, it is preferable that the fineness is in the range of 2 and 12 denier. If the fineness is too small, it tends to be difficult to produce conjugated fibers. On the contrary, if the fineness is too large, the hand feeling tends to be hard.

Moreover, the fineness of the branch fiber comprising the component A and the fineness of the fine fiber comprising the component B vary depending upon the shape of the cross section of the splittable conjugated fiber. In addition, since the fineness may be modified according to the objects or applications, the fineness is not limited. However, in general, in the case of the conjugated fibers as shown in FIG. 1 to FIG. 5, it is preferable that the fineness of the branch fiber comprising the component A is in the range of 1.2 to 8 denier; the fineness of the fine fiber comprising the component B is in the range of 0.1 to 1 denier. On the other hand, in the case of the conjugated fiber as shown in FIG. 6(*a*), it is preferable that the fineness of the branch fiber comprising the component A is in the range of 0.25 to 1.2 denier; the fineness of the fine fiber comprising the component B is in the range of 0.1 to 1 denier; the fineness of the component different from the component A which is located in the center of the component A is in the range of the 0.2 to 1 denier.

It is preferable that the non-woven fabric of the present invention is produced by conjugated fibers composed of filaments. Consequently, the obtained non-woven fabric is excellent in the mechanical strength, has the high strength of the non-woven fabric, and generates little fuzz, and the productivity of the non-woven fabric is high.

In the present invention, the method for producing the non-woven fabric composed of filaments is not particularly limited. However, the so-called spun bond method is preferably used. Specifically, for example, each resin component constituting the conjugated filament is introduced in the individual extruders and is melt and spun by the use of an appropriate composite spinneret, which can be selected depending on the intended shapes of the splittable conjugated filaments. The shape of the slit of the orifice of the spinnerets can be made in the desired shaped modified cross section by using a spinneret having the same shape as that of the conjugated filament. A group of filaments released out of the spinneret are introduced into an air sucker and stretched to produce a group of filaments. Then, a group of filaments discharged out of the air sucker is charged by the use of an appropriate charging apparatus such as corona discharging apparatus, and then are made to pass through between a couple of vibrating wing-like tools (flaps) for an opening to open the filaments, or they are made to impact on an appropriate reflecting board etc. to open fibers. The group of the opened filaments are accumulated as filament fleeces on a collecting endless belt conveyor having a sucker on its back face.

The deposited filament fleeces are made to pass through the heated or unheated surface smooth nip roll with high linear load to split the conjugated filaments, followed by nipping the filament fleeces and crossing partial adherence between filaments by using an emboss roll that is heated at the temperature below and near the melting point of the low melting point component and a surface smooth roll that is located at the opposite side of the embossing roll, to thus produce the non-woven fabric composed of filaments.

Moreover, the splitting treatment may be conducted by an appropriate splitting treatment which is known as the splitting treatment for the conjugated fibers, for example, a high pressure water stream entangling method, a needle punching method, and a wrinkling processing method. The method for adhering between filaments so as to make the filament fleeces into a non-woven fabric (or to entangle, or to thermally adhere) also is not limited to the thermal adhering method by the use of the embossing roll. The ultrasonic wave welding method or hot air circulating method using hot air whose temperature is more than the melting point of the low melting point component and less than the melting point of the high melting point component etc. may be used.

In order to obtain the non-woven fabric of the present invention, the order of the splitting step of the conjugated fiber and the step for adhering between fibers is not important. The splitting treatment may be conducted after the adhering treatment.

In addition, processing for a softening may be conducted so as to enhance the softness of the resultant non-woven fabric.

Moreover, it is preferable that the non-woven fabric of the present invention is laminated onto another melt blown non-woven fabric, since the hand feeling becomes good, bulkiness becomes high, the strength of the melt blown non-woven fabric is supported, and the strength of the non-woven fabric is enhanced by the multiplier effect of both non-woven fabrics. Moreover, the non-woven fabric of the present invention is characterized in that the laminated non-woven fabric laminating another film, a non-woven fabric produced by the carding process, and a non-woven fabric produced by the air laid process is also more excellent in hand feeling and better in bulkiness as compared with the laminated non-woven fabric laminating the non-woven fabric comprising the usual not-splittable filaments and the above materials.

In the present invention, the non-woven fabric, which is useful for each intended object, has an excellent hand feeling and high bulkiness, can be obtained by selecting the kinds of combining thermoplastic resins, cross sections of the conjugated fiber, spinning conditions, splitting conditions, adhering conditions etc.

In addition, since the non-woven fabric of the present invention has an excellent bulkiness and hand feeling, it is preferably used for an absorbent article. The absorbent articles include paper diapers, sanitary napkins, incontinence pads etc. The non-woven fabric of the present invention is used for the portions of the absorbent articles where the non-woven fabrics have been conventionally used. In a case where the non-woven fabrics of the present invention are used as absorbent articles, it is generally used by laminating absorbent materials such as high molecular absorbent articles. The non-woven fabric in the present invention can provide an absorbent articles which has an excellent permeability with respect to body fluid such as urine, sweat, blood or the like because of its high bulkiness and coarse density. Moreover, these non-woven fabrics provide non-woven fabric layers of a sufficient thickness, so that the back flow of the absorbed fluid is inhibited and the feeling of dryness is enhanced. In addition, the non-woven fabric of the present invention has an excellent hand feeling and softness. Moreover, the split fine fibers in the non-woven fabric can provide an excellent hand feeling. Therefore, the place where such non-woven fabric is used is not particularly limited, but, in general, it is preferably used as a surface material (a material of the side contacting with users' skin) of the absorbent article.

Hereinafter, the present invention will be described in more detail by referring to the Examples and Comparative Examples but is not limited to them alone.

Moreover, the definitions of the physical parameters of the absorbent article in Examples and the methods for determining the parameters are as follows.

1. Hand Feeling

Five panelists evaluated the hand feeling of non-woven fabrics in the viewpoints of softness, touch etc. and the grade was based on the following standards.

Good: Three or more panelists felt that the non-woven fabric was soft or had a good hand feeling.

Poor: Three or more panelists did not feel that the non-woven fabric was soft or had a good hand feeling.

2. Bulkiness (Specific Volume)

A bulkiness is represented by a volume per unit weight. "cc/g" is used as a unit. The higher this value is, the higher the bulkiness is. The non-woven fabric of 18 cc/g or more is regarded as high bulkiness.

3. Splitting Ratio

Ten portions in the non-woven fabric were selected optionally. Cross sectional photographs of a cross section of the non-woven fabric enlarged by 100 times were taken. Then, in ten cross sectional photographs, the ratio of the number of all fibers appearing in the photographs (including split fibers, partly split fibers, and not-split fibers) with respect to the total number of splittable minimum fiber units is defined as a splitting ratio (%).

Figure 7:
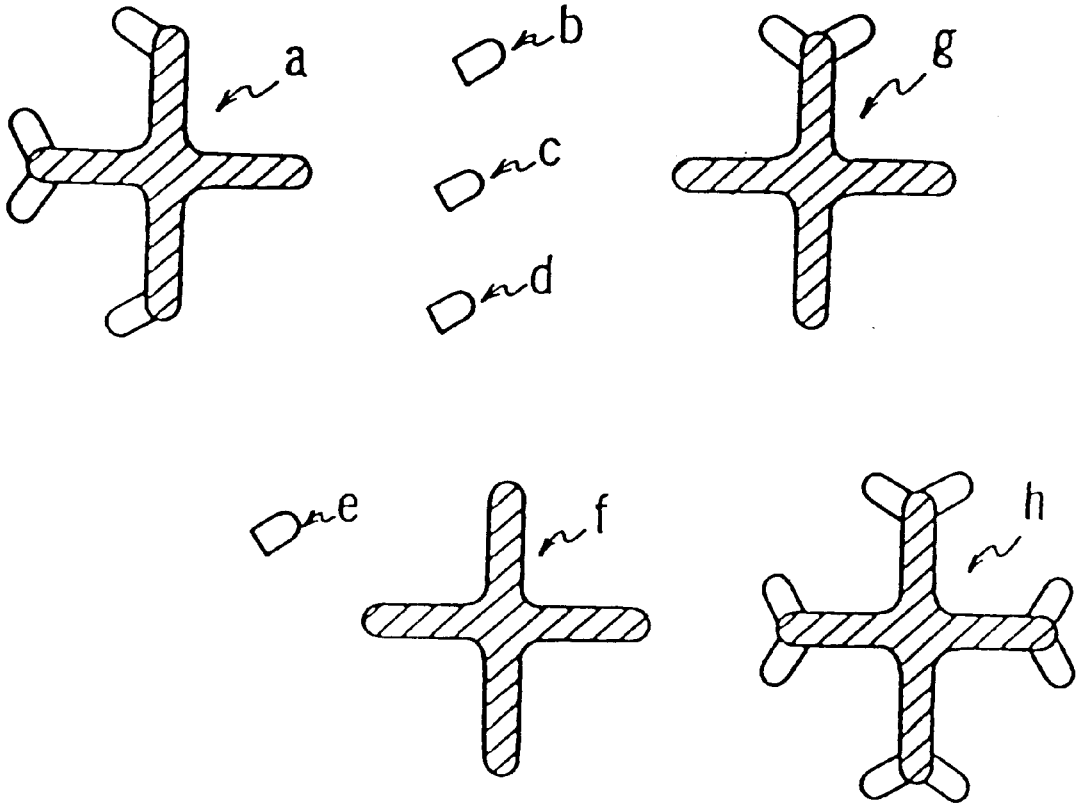
FIG. 7 is a cross sectional view representing a typical enlarged sectional photograph of cross sections of optionally selected portion of the non-woven fabric of the present invention, for explaining a splitting ratio.

In order to explain the splitting ratio with understandability, FIG. 7 is referred to. FIG. 7 is an imaginary model view for explaining a splitting ratio. It assumes cross sectional photographs enlarged by one hundred times, of cross sections of one optionally selected portion. (These are not copies of the real photographs but are imaginary model views for explaining the splitting ratio. Therefore, the magnification is not exactly 100 times.) According to FIG. 7, eight fibers exist in total (fibers marked by the marks "a" to "h"), and they correspond to the total number of fibers. (Only one photograph is shown herein, but in fact, ten photographs are totalized.) The number of the splittable minimum unit is: the fiber "a" has five; each of "b", "c", "d", and "e" has one; "f" has one; "g" has three, and "h" has nine. The total, therefore, is 22, which corresponds to the number of the splittable minimum unit. (Only one photograph is shown herein, but in fact, ten photographs are totalized.) The splitting ratio is calculated by the following equation: [(the total number of fibers)/(the total number of splittable minimum unit)]×100(%). For example, the splitting ratio of FIG. 7 calculated by this equation with respect to the use of this one photograph is: (8÷22)×100=36(%).

4. Permeation Speed

A stainless steel cylinder of 50 mmϕ, a thickness of 4 mm and a weight of 50 g was placed on the non-woven fabric of the present invention under which an absorbing sheet used in a paper diaper ("Moony man", the product of Uni-charm Corporation) is layered, followed by feeding 50 cc of 0.9 wt. % of physiological saline solution into the cylinder at one stroke, and determining the period of time from the feeding until the solution was absorbed in the sample. The period of time was regarded as permeation speed.

5. Bleeding Property

Spot absorption was evaluated in terms of bleeding property. After the determination of the permeation speed, the longest diameter of the trace of physiological saline solution spread in the sample sheet was assumed as "L" (the unit is "mm"), and the value calculated by the equation (L-50)/50 was regarded as the bleeding property.

6. Back Flow Property

After the determination of the permeation speed, the sample fabric was allowed to stand for 3 minutes, and a filter paper ("No. 2", the product of Advantec Toyo Co Ltd.) was placed on the non-woven fabric having an absorbent sheet. The weight of the physiological saline solution absorbed by the filter paper when a load of 5 kg was added on the filter paper for 30 seconds was regarded as the back flow property.

EXAMPLE 1

Polypropylene was used as the component A (the branch fiber) and polyethylene was used as the component B (the fine finer). Polypropylene was melted at 300° C. and extruded from one extruder, polyethylene was melted at 250° C. and extruded from another extruder. The both extruded components were provided to the spinneret being heated at 280° C. and having a cross section whose shape was like FIG. 5(*a*), to thus conduct a melt spinning. The spun conjugated filaments were made to pass through an air sucker, sucked with an air sucker at the speed of 2500 m/min., opened by compulsorily charging by the use of charging apparatus, and then accumulated on a collecting conveyor. The shape of the cross section of the resultant splittable conjugated fiber constituting a filament fleece was shown like FIG. 5(*a*). Moreover, each fineness of the components A (the branching fiber) 2 was 3 denier; and each fineness of the components B (the fine fiber) 3 was 0.8 denier. The obtained filament fleece was made to pass through a smooth surface roll (a nip roll) at room temperature to split the splittable conjugated fiber, followed by passing through a pressed roll of the point bond processor comprising an embossing roll and a smooth roll heated to 120° C. to partially conduct thermal adhesion between filaments. The resultant non-woven fabric had a splitting ratio of 50% and a bulkiness of 20 cc/g in specific volume, exhibiting a high bulkiness and an excellent hand feeling. Moreover, as is apparent from Table 1, the non-woven fabric of the present invention exhibited an excellent property when being used as an absorbent article.

COMPARATIVE EXAMPLE 1

The non-woven fabric was obtained by the same way as Example 1 except that the splitting treatment was not carried out, and an air through method (a hot air circulating method at 130° C.) was applied for thermal adhesion between filaments.

The obtained non-woven fabric had a splitting ratio of 0% and a bulkiness of 21 cc/g in specific volume. The non-woven fabric had some good properties as an absorbent article but it was poor in hand feeling.

EXAMPLE 2

The non-woven fabric was obtained in the same way as Example 1 except that an air through method (hot air circulating method at 130° C.) was applied for thermal adhesion between filaments.

The obtained non-woven fabric had a splitting ratio of 70% and a bulkiness of 30 cc/g in specific volume, exhibiting an excellent hand feeling. Moreover, as is apparent from Table 1, the non-woven fabric of the present invention exhibited an excellent property when used as an absorbent article.

EXAMPLE 3

The non-woven fabric was obtained by the same way as Example 1 except that a water jet (pressure was 70 kg/cm2) was used as the splitting method.

The obtained non-woven fabric had a splitting ratio of 80% and a bulkiness of 20 cc/g in specific volume, exhibiting an excellent hand feeling. Moreover, as is apparent from the results shown in Table 1, the non-woven fabric of the present invention exhibited an excellent property when used as an absorbent article.

COMPARATIVE EXAMPLE 2

The non-woven fabric was obtained in the same way as Example 1 except that polypropylene was used for both components A and B, and the temperature of both extruders was made to be 300° C. Moreover, the entire fineness was 9.8 denier.

The obtained non-woven fabric had a splitting ratio of 0% and a bulkiness of 20 cc/g in specific volume. The non-woven fabric had some good properties as an absorbent article but it was poor in hand feeling.

EXAMPLE 4

Polyethylene terephthalate was used as the component A (the branch fiber), polyethylene was used as the component B (the fine fiber), and the component B was used for the component located in the center of the component A, that is, a material different from the component A. Polyethylene terephthalate was melt at 350° C. and extruded from one extruder, polyethylene was melt at 250° C. and extruded from another extruder. The both extruded components were provided to the spinneret which was heated at 300° C. and had a cross section whose shape was like FIG. 6, to thus conduct a melt spinning. The spun conjugated filaments were made to pass through an air sucker, sucked with the air sucker at the speed of 2000 m/min., opened by compulsorily charging by the use of charging apparatus, and then accumulated on a collecting conveyor. The shape of the cross section of the resultant splittable conjugated filaments constituting a filament fleece was like that shown in FIG. 6(*a*). Moreover, each fineness of the components A (the branching fiber) 2 was 0.8 denier; each fineness of the components B (the fine fiber) 3 was 0.8 denier; and each fineness of the components used for the component located in the center of the components A, that is, the component different from the components A (the component B 4) was 0.3 denier. The obtained filament fleece was split by using the needle punch and adhered by using a through air method (the hot air circulation method at 136.). The resultant non-woven fabric had a splitting ratio of 75% and a bulkiness of 22 cc/g in specific volume, exhibiting a high bulkiness and an excellent hand feeling. Moreover, as is apparent from Table 1, the non-woven fabric of the present invention exhibited an excellent property when being used as an absorbent article.

COMPARATIVE EXAMPLE 3

The non-woven fabric was obtained in the same way as Example 4 except that the shape of the cross section of the conjugated filament was like a shape shown in FIG. 10. Moreover, in FIG. 10, polyethylene terephthalate (1 denier) was used as the high melting point component 12, and polyethylene (1 denier) was used as the low melting point component 13.

The resultant non-woven fabric had a splitting ratio of 50% and a bulkiness of 13 cc/g of specific volume, exhibiting low bulkiness and a poor hand feeling. Moreover, the obtained non-woven fabric exhibited a poor property when being used for an absorbent article.

Moreover, the results of Examples 1 to 4 and Comparative Examples 1 to 3 were shown in the following Table 1. The evaluation of permeability, bleeding property, and back flow property, which are important parameters for absorbent articles, are also described in this Table 1.

TABLE 1

| | Example 1 | Comparative Example 1 | Example 2 | Example 3 | Comparative Example 2 | Example 4 | Comparative Example 3 |
|---|---|---|---|---|---|---|---|
| Components A/B | PP/PE | PP/PE | PP/PE | PP/PE | PP/PP | PET/PE | PET/PE |
| Shape of Cross section | FIG. 5 | FIG. 5 | FIG. 5 | FIG. 5 | FIG. 5 | FIG. 6 | FIG. 9 |
| Adhering Method | EB | TA | TA | EB | EB | TA | TA |
| Splitting Method | roll | Not Treated | roll | WJ | WJ | NP | NP |
| Splitting Ratio (%) | 50 | 0 | 70 | 80 | 0 | 75 | 50 |
| Specific Volume (cc/g) | 20 | 21 | 30 | 20 | 20 | 22 | 13 |
| Hand Feeling | ○ | x | ○ | ○ | x | ○ | ○ |
| Permeation Speed (second) | 17 | 15 | 11 | 15 | 18 | 13 | 25 |
| Bleeding Exudation Property (%) | 26 | 20 | 23 | 25 | 27 | 22 | 60 |
| Back Flow Property (g) | 1.8 | 1.5 | 1.4 | 1.5 | 1.5 | 1.3 | 2.9 |

(note) PP: polypropylene
PE: polyethylene
PET: polyethylene terephthalate
EB: emboss roll
TA: through air (method)
WJ: water jet (method)
NP: needle punching (method)
○ good hand feeling
x: bad hand feeling (1) The non-woven fabric of the present invention comprises fibers comprising: splittable conjugated fibers comprising at least two resin components A and B and having a cross section where the component A forms a branch fiber in which a strand extends radially from the center to the outside and the component B forms a fine fiber which connects to and protrudes from the branch fiber; split branch fibers of the conjugated fiber; and split fibers of the fine fibers. In the non-woven fabric, specific modified cross section conjugated fiber comprising the branching fiber and the fine fiber, the split fibers from this modified cross sectional conjugated fiber are mixed, thus providing the non-woven fabric with a softness, an excellent hand feeling and a sufficient high bulkiness.

(2) In the non-woven fabric of the present invention according to the above item (1), the splittable conjugated fiber has the different component from the component A in the center of the component A, and the split fiber comprising the different component is further mixed in the fibers of the non-woven fabric. By such preferred embodiment, the non-woven fabric has the above mentioned excellent bulkiness and more improved hand feeling.

(3) Further, in the non-woven fabric of the present invention according to the above item (1), the splittable conjugated fiber comprises the component A forming the branch fiber in which at least three strands extend radially from the center to the outside, and the component B forming two or more fine fibers which protrude from the vicinity of the tip of each strand in a direction that intersects the longitudinal direction of the strand with pairs of fine fibers extending in directions opposite to each other from opposed face of each strand. By such preferred embodiment, the non-woven fabric preferably has a more excellent bulkiness and an improved hand feeling.

(4) Further, in the non-woven fabric of the present invention according to the above item (3), the splittable conjugated fiber has the component different from the component A in the center of the component A, and the split fiber comprising the different component is further mixed in the fibers of the non-woven fabric. By such preferred embodiment, the non-woven fabric preferably has a more excellent bulkiness and an improved hand feeling.

(5) Further, in the non-woven fabric of the present invention, the resin components constituting the thermoplastic fiber is at least one selected from the group consisting of polyolefin resin, polyester resin, and polyamide resin. By such preferred embodiment, it is preferable that the non-woven fabric having a softness, an excellent hand feeling and a high bulkiness can be obtained at relatively low price.

(6) Further, the non-woven fabric of the present invention, the thermoplastic fiber comprises a filament which is a continuous fiber. By such a preferred embodiment, the non-woven fabric is excellent in mechanical strength such as tensile strength etc., and has a little fuzz generation.

(7) According to the present invention, the non-woven fabric of the present invention is used for absorbent articles. The absorbent article can be provided in which the permeation speed of the liquid is high, and absorption property is good, the feeling of dryness is enhanced because the back flow of the permeated body fluid is small, a hand feeling is excellent and softness is excellent.

INDUSTRIAL APPLICABILITY

According to the above mentioned effect, the non-woven fabric of the present invention is used for various applications, such as for clothes, industrial materials, materials for civil engineering and construction, materials for agricultural gardening, materials for daily necessities, medical and hygienic materials etc. and suitable for the absorbent articles such as paper diapers, sanitary napkins, incontinence pads or the like. Moreover, the absorbent articles of the present invention is preferably used for, such as paper diapers, sanitary napkins, incontinence pads or the like.

What is claimed is:

1. A non-woven fabric which comprises thermoplastic fibers, the fibers comprising:

a splittable conjugated fiber comprising at least two resin components A and B, the conjugated fiber having a cross section where the component A includes a branch fiber in which a strand of the branch fiber extends radially from the center of the conjugated fiber to the outside of the conjugated fiber and the component B includes a fine fiber which connects to and protrudes from the branch fiber;

a split branch fiber that has been split from said conjugated fiber; and a split fine fiber that has been split from said conjugated fiber.

2. The non-woven fabric according to claim 1, wherein said splittable conjugated fiber has a component different from the component A in the center of the conjugated fiber, and a split fiber comprising said different component is further mixed in the fibers of the non-woven fabric.

3. The non-woven fabric according to claim 1, wherein said splittable conjugated fiber comprises the component A and the component B, said component A includes the branch fiber in which at least three strands of the branch fiber extend radially from the center of the conjugated fiber to the outside of the conjugated fiber, wherein at least one strand of the branch fiber has a first face and a second face opposed to said first face, and said component B includes two or more fine fibers which protrude from the opposed faces of the at least one strand of the branch fiber in the vicinity of a tip of the at least one strand of the branch fiber.

4. The non-woven fabric according to claim 3, wherein said splittable conjugated fiber has a component different from the component A in the center of the conjugated fiber, and a split fiber comprising said different component is further mixed in the fibers of the non-woven fabric.

5. The non-woven fabric according to claim 1, wherein the thermoplastic fiber comprises at least one resin component selected from the group consisting of polyolefin resin, polyester resin, and polyamide resin.

6. The non-woven fabric according to claim 1, wherein the thermoplastic fiber comprises filament which is a continuous fiber.

7. An absorbent article comprising the non-woven fabric according to claim 1.

8. An absorbent article comprising the non-woven fabric according to claim 2.

9. An absorbent article comprising the non-woven fabric according to claim 3.

10. An absorbent article comprising the non-woven fabric according to claim 4.

11. An absorbent article comprising the non-woven fabric according to claim 5.

12. An absorbent article comprising the non-woven fabric according to claim 6.

* * * * *

UNITED STATES PATENT AND TRADEMARK OFFICE

CERTIFICATE OF CORRECTION

PATENT NO. : 6,309,377 B1
DATED : October 30, 2001
INVENTOR(S) : Tsujiyama et al.

It is certified that error appears in the above-identified patent and that said Letters Patent is hereby corrected as shown below:

Title page,
Item [63] Related U.S. Application Data: "August 27, 1996" should read -- August 22, 1997 --

Signed and Sealed this

Fourth Day of June, 2002

*Attest:*

*Attesting Officer*

JAMES E. ROGAN
*Director of the United States Patent and Trademark Office*